US006647574B2

(12) United States Patent
Weber

(10) Patent No.: US 6,647,574 B2
(45) Date of Patent: Nov. 18, 2003

(54) COUPLED WAVEBAND SUSPENSION FOR BEDDING AND SEATING UNITS

(75) Inventor: Erhard Weber, Osnabrueck (DE)

(73) Assignee: L&P Property Management Company, Southgate, CA (US)

( * ) Notice: Subject to any disclaimer, the term of this patent is extended or adjusted under 35 U.S.C. 154(b) by 0 days.

(21) Appl. No.: 10/169,276

(22) PCT Filed: Jan. 12, 2001

(86) PCT No.: PCT/US01/01047

§ 371 (c)(1),
(2), (4) Date: Nov. 25, 2002

(87) PCT Pub. No.: WO01/50924

PCT Pub. Date: Jul. 19, 2001

(65) Prior Publication Data

US 2003/0196272 A1 Oct. 23, 2003

(30) Foreign Application Priority Data

Jan. 13, 2000 (DE) ..... 200 00 477 U

(51) Int. Cl.[7] ..... A47C 23/00; F16F 3/00

(52) U.S. Cl. ..... 5/719; 5/241; 5/247; 5/258; 5/264.1; 267/87; 267/103

(58) Field of Search ..... 5/719, 239, 241, 5/242, 247, 255, 258, 263, 264.1, 265; 267/87, 103, 107

(56) References Cited

U.S. PATENT DOCUMENTS

| | | | |
|---|---|---|---|
| 16,254 A | 12/1856 | Wright | 5/258 |
| 65,617 A | 6/1867 | Tower | 5/258 |

(List continued on next page.)

FOREIGN PATENT DOCUMENTS

| | | |
|---|---|---|
| CH | 120690 | 6/1927 |
| DE | 44883 | 10/1888 |
| DE | 10007296 | 8/2000 |
| EP | 0793432 | 3/1999 |
| GB | 243915 | 12/1925 |
| GB | 323224 | 12/1929 |
| WO | WO99/47027 | 9/1999 |
| WO | WO 01/50924 | 7/2001 |

*Primary Examiner*—Robert G. Santos
(74) *Attorney, Agent, or Firm*—Wood, Herron & Evans, L.L.P.

(57) ABSTRACT

A coupled waveband (14, 21) suspension for bed underframes, seating, upholstery, and mattresses consists of several sinusoidal wavebands (14, 21) which run parallel and/or transversely to the longitudinal axis. Support elements (12, 35) are rigidly or moveably fixed to or ride on the crests or maxima of the wavebands (14, 21). The troughs or minima are supported by slide or roll bearing elements (17) affixed to the frame. A strong interactive coupling is achieved between the support elements (12, 35) causing a positive stroke of the less pressure-loaded segments and the appropriate support elements by the simultaneous lowering of the pressure-loaded waveband segments. The wavebands (14, 21) are manufactured out of higher quality, elastically flexible sold plastic or foam material, or of spring steel band or wire, duralumin, or out of formed laminated wood. In one embodiment, the suspension system includes crossed single or double storied wavebands (14, 14A, 21, 21A) affixed in pockets (90) or niches of the foam side construction of the mattress and which are freely moveable in most of the inner part of the core. In another embodiment, two crossed sets of wavebands (14, 14X, 21, 21X) are used with each crest of one set situated opposite to a trough of the other one thus providing a close support coverage of the surfaces.

26 Claims, 11 Drawing Sheets

U.S. PATENT DOCUMENTS

| | | | | |
|---|---|---|---|---|
| 66,849 | A | 7/1867 | Johnson | 5/258 |
| 95,553 | A | 10/1869 | Bates | 5/264.1 |
| 106,069 | A | 8/1870 | Lord | 5/258 |
| 1,273,428 | A | 7/1918 | Vincent | 5/258 |
| 1,333,801 | A | 3/1920 | Fitzgerald | 267/90 |
| 1,944,614 | A | 1/1934 | Salmon | 5/258 |
| 4,771,995 | A | 9/1988 | Wells et al. | 267/103 |
| 5,058,224 | A | 10/1991 | Aschwanden et al. | 5/238 |
| 5,060,326 | A | 10/1991 | Oswald | 5/236.1 |
| 5,210,889 | A | 5/1993 | Wesemann et al. | 5/236.1 |
| 5,265,290 | A | 11/1993 | Van Raemdonck | 5/236.1 |
| 5,414,874 | A | 5/1995 | Wagner et al. | 5/263 |
| 5,426,799 | A | 6/1995 | Ottiger et al. | 5/719 |
| 5,558,314 | A | 9/1996 | Weinstein | 267/91 |
| 5,588,165 | A | 12/1996 | Fromme | 5/247 |
| 5,784,731 | A | 7/1998 | Weber | 5/238 |
| 5,787,533 | A | 8/1998 | Fromme | 5/719 |
| 5,924,149 | A | 7/1999 | Weber | 5/238 |
| 6,487,738 | B1 * | 12/2002 | Graebe | 5/719 |

* cited by examiner

COUPLED WAVEBAND SUSPENSION FOR BEDDING AND SEATING UNITS

This claims priority to German Patent Application No. 200 00 477 U1 filed Jan. 13, 2000 and hereby Incorporated by reference in its entirety.

FIELD OF THE INVENTION

This invention is for a suspension system for bedding or seating units, and more particularly for a coupled waveband suspension system for bedding underframes, mattresses, seating products and upholstery, which makes possible an interactive coupling of individual support elements for such units.

A wide variety of beds, underframes, support systems and seating products have been made commercially available. One type of such product is a standard metal bed base or spring base which includes a perimeter frame to which a metal mesh, usually of spring steel, is fixed for elastically supporting the mattress. The structure remains taut within the frame and gives a firm rigid base to a mattress supported thereon. However, such a bed base or foundation unit has certain disadvantages in that over time the structural elasticity of the metal mesh decreases considerably. As a result, the base sinks or sags similar to a hammock with the resulting unnatural or uncomfortable positioning of someone or on top thereof.

Another type of bedding support or foundation underframe includes a number of rigid planks or boards spanning across a perimeter frame which is also typically wooden panels. This type of construction is commonly referred to as a box spring and the wooden frame unit prevents the typical sinking of the metal mesh base as previously described. However, this type of unit does not adapt to the various shapes of individual users and offers poor ventilation or transpiration.

Another common variation is an elastic slatted bed base which includes a plurality of slats positioned transversely on a frame and coupled to the frame by elastic joints. The slats are elastic and upwardly curved to support a load such as someone lying atop as a mattress or a foundation unit. Such systems typically offer adequate adaptability to the natural curves of the human spine and torso and provide appropriate support for heavier parts of the human body such as the shoulders and hips region as well as lighter regions of the body such as the head, arms and lower legs. However, these type of individual slat or lath units only react passively to the stresses of a distended body and are primarily influenced by the weight of the human body. The slats or laths are not self adjusting to provide adequate support and comfort.

Finally, waterbeds or mattresses are well-known and consist essentially of a container or multiple containers of impermeable material containing water or other fluid. Waterbeds or mattresses adapt well to the anatomy of a distended body but do not adequately support the vertebral column.

Compared to the state of the art, the task of the present invention is to achieve an interactive, forced coupling of multiple support elements in bed underframes, mattresses, seating units and the like while providing a positive suspension stroke of the support elements and associated segments under less pressure. Further, the load supporting elements preferably offer a total stroke of the order of the construction height of the suspended support elements while yielding a relatively low lateral shearing force to the support elements and associated structure. Optimally, all of these objectives would be utilized in bed underframes, mattresses, seating products and upholstery, with simple materials and construction.

SUMMARY OF THE INVENTION

The solution of this task is achieved with waveband-suspended support elements as shown and described in representative embodiments in the figures and following detailed description and is based on the following construction characteristics:

- Wavebands of an elastically flexible material are used which run parallel and/or transversely to the side spars of a bed underframe or to the longitudinal axis of a mattress for the basic suspension and the simultaneous coupling of the elements;
- The endcaps or respectively the support elements ride or sit affixed upon the crests or maxima of the sinusoidal waveband, or are moveable with roll bearings or, alternatively, are manufactured of the same material;
- The troughs or minima of the band slide, roll or otherwise move relative to bearing elements which divide the waveband into dynamically coupled segments;
- When pressure load is applied to such a unit, individual support elements or segments and simultaneously a shift of parts of the waveband to neighboring segments causes a positive stroke of the loaded support elements. Hereby a total stroke h of the order of the construction height H of the waveband plus support elements is attained;
- The high degree of comfort obtained from the waveband suspension system makes the use of simple constructions of the complementary counterpart, bed underframe or mattress, possible.

By joining all the individual elements which are sitting upon or are affixed to the maxima of a sinusoidal, elastically flexible waveband, a comparably large positive stroke of less pressure loaded waveband segments is caused in addition to the usual springy suspension stroke in a negative direction.

DESCRIPTION OF THE RELATED ART

The current state of the art is described in the European Patent EP 0 793 432. Many different endcaps as well as individual support elements are listed and itemized in EP 0 793 432. The Triflex endcaps described there have been diversified and have found application in individual support elements, Rotaflex, and in mattress cores in the German Registered Design 299 02 965.4 and in the German Patent application 100 07 296.8.

In European Patent EP 0 793 432 and U.S. Pat. No. 5,924,149 an interactive coupling of the Triflex endcaps by means of a flexible band is described which, however, allows no positive stroke.

In the PCT Application WO99/47027, a multilayer slatted frame for seats and beds is described which comprises straight and curved cross slats (out of formed wood) running solely laterally to the bed axis. These slats are held in woven loops and can be supported by elastic bodies of different heights made of foam material or fluid (air, water or gel) filled covers. These bodies sit between the curved and the straight cross slats or longitudinal spars.

The curved cross slats have the form of a normal or a twice curved bow and the ends of which as well as the one or two tops are held in place by superimposed woven loops upon the lower straight cross slats or longitudinal spars or they support the upper straight cross slats, respectively. This offers a deformable sandwich construction.

The PCT Application WO99/47027 does not disclose minima of the curved cross slats, or of any other kind, that move, glide, slide or roll on bearings, flat products, or the like. Those bow-shaped curved cross slats have only two minima at their outer ends in contact with and held in woven loops upon the lower straight cross slats or the longitudinal spars. The one or two maxima of the bow-shaped slats do not support and couple individual support elements, or flat products, nor endcaps of cross slats; nor is a perceptible positive adjustment stroke achieved.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
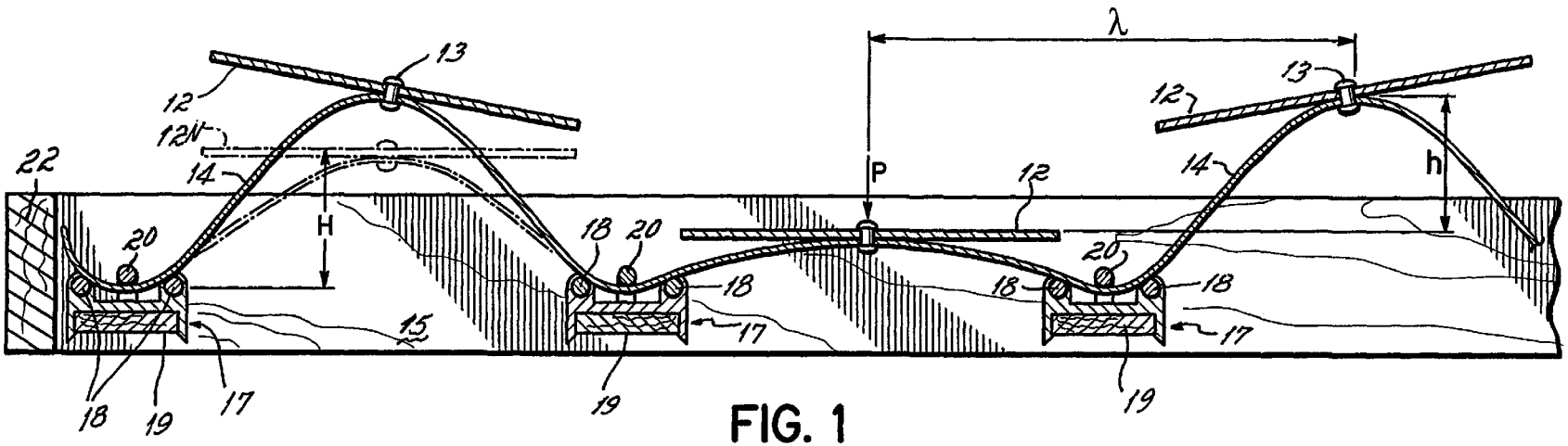
FIG. 1 is a cross-sectional view of waveband-suspended, individual support elements for a bed underframe according to one embodiment of this invention.

In FIG. 1 the cross-section of three segments of waveband-suspended, individual support elements is shown with support elements or plates 12 affixed with rivet-like bolts 13 to the crests or maxima of the waveband 14 which runs parallel to the side spar 15 of the bed underframe (or with support plates forming a material compound with waveband). At a given wave interval (wavelength, $\lambda$=12.8–18 cm), fourteen to ten support elements 12 are interconnected and thereby coupled by the waveband 14 lengthwise measuring, e.g., 200 cm.

Five to seven wavebands 14 of the same type with a width of B=30–70 mm (see FIG. 2) run parallel to each other at intervals of 15 to 19 cm and thus yield the resolved suspended surface of 50–84 individual support elements for a 90–100 cm wide underframe. For the outermost wavebands running close to the side spar of the frame, the support elements reach over the spars (see FIG. 2) so that the totality of the underframe surface is resolved and coupledly suspended.

In the troughs or minima of the waveband 14 there are bearing elements 17 arranged with rolls or round slide rods 18, on which the waveband 14 can move almost without friction. These bearing elements 17 are affixed to or clipped onto cross slats 19 of the frame. Securing rods 20 reaching alternatively from the right or from the left over the waveband 14 to prevent it from being lifted off of the bearing element 17.

A pressure load p onto one (or several) support element(s) results in a lowering (negative stroke) of selected crests and associated support elements and segments(s) and a simultaneously to rising (positive stroke) of the neighboring waveband crests and support elements or segments. This results in a total stroke h comparable to or larger than the construction height H (see the height H at the normal position of the dotted plate 12A) of the waveband sprung support elements. At the same time the plates 12 may pivot or incline towards the nearest, pressure loaded support element, crest or segment. The positive supporting stroke of about half of the total stroke h is unique and characteristic for the waveband suspension.

A short discussion of the total stroke h, of suitable materials and thicknesses of the wavebands as well as their physical properties is found at the end of the description of the invention. The effective change in length of the waveband 14 caused by the pressure loading is limited by the transverse spars 22 of the frame at the head and foot ends of the bed, and where necessary by suitable stops. The approximately B=30–70 mm wide waveband 14 made of solid, foam or wire material ensures good stability against lateral shearing against the direction of the waves. The nearest independent support elements sitting on separate wavebands can be connected with flexible and preferably also elastic tongues (not shown) which additionally cause a coupling between the parallel running wavebands. The choice of material and the thickness of the connecting tongues will permit adjustment of the degree of interaction between the wavebands.

Figure 2:
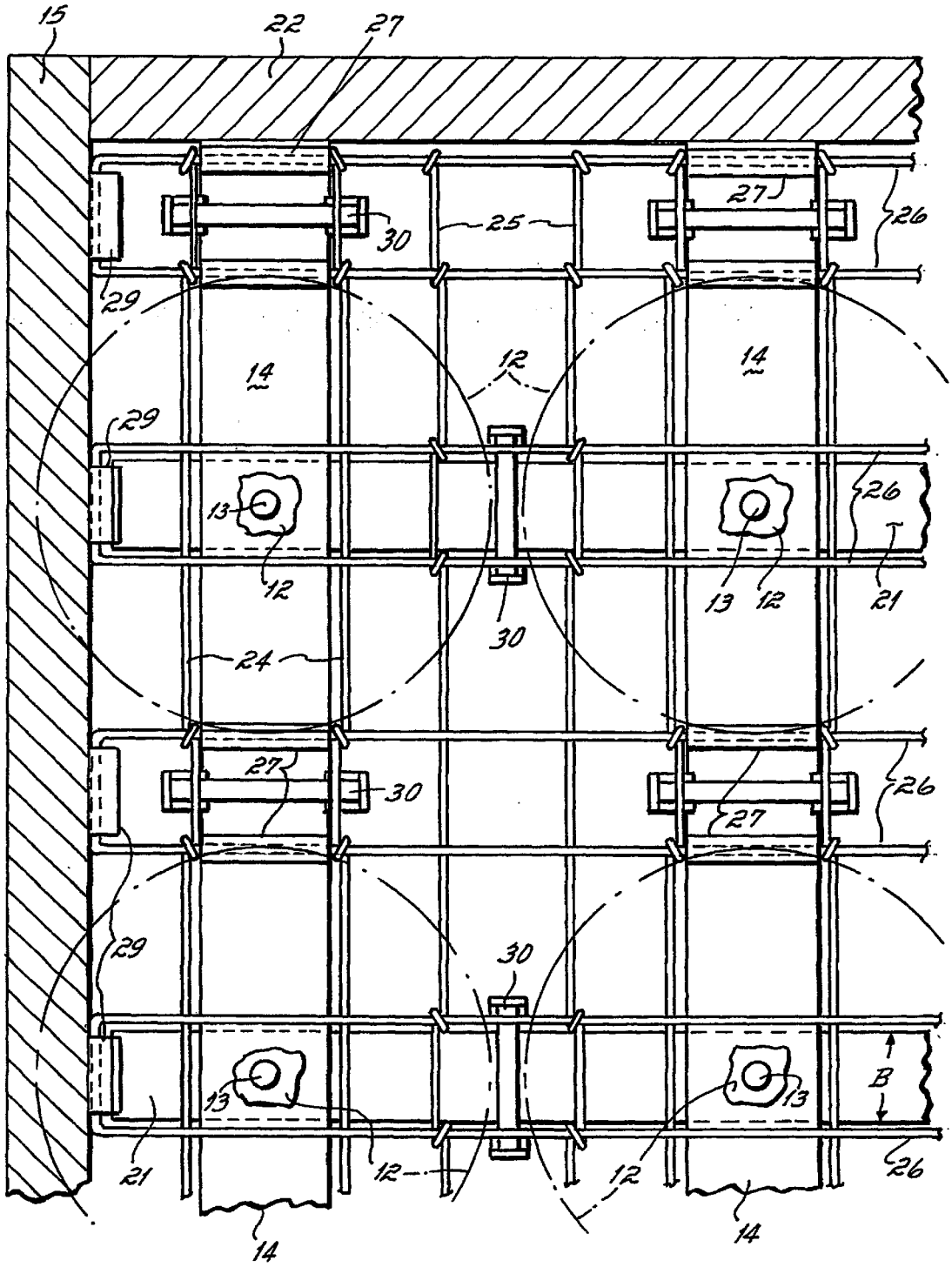
FIG. 2 is a top view of a resolvedly sprung surface of a bed underframe consisting of individual support elements suspended by crossed wavebands.

Referring to FIG. 2, another embodiment for coupling, as shown schematically in top view in this figure, includes arranging lateral or traverse wavebands 21 tat right angles to the longitudinal ones 14. In all coinciding maxima support plates 12 are fastened with a rivet-like bolt 13 or the like. By means of the material, the thickness and the width B of the transverse wavebands 21, the strength of the interactive coupling can be selected and adjusted between the longitudinal wavebands 14 and thus between all individual support elements 12.

The troughs or minima of the wavebands 14 and 21 are supported by a lattice of frame elements in the form of a net of longitudinal 24, 25 and transversely running 26 double wires, either directly by the longitudinal wires 25 acting as a slide bearing or by roll or slide bearings 27 put onto the double wires 26. This wire net and the integrated or separate slide bearings 27 are suitable for an automated mass production. The wire net is connected to the peripheral frame 15 via fittings 29 affixed to the side spar over the transverse wires 26. Winding the longitudinal wires 24 and 25 around the transverse ones 26 serves as a side guide and securing rods 30 prevent the wavebands 14, 21 from being lifted off.

In another construction scheme, the wire net can be replaced by cross slats 19 (compare FIG. 1) mounted at the same interval as the transverse double wires 26 and with separate slide or roll bearings clipped onto the slats which moveably support the minima of the wavebands 14, 21. FIG. 1 shows the cross section corresponding to FIG. 2 with the transverse wires 26 replaced by the cross slats 19 and the transverse wavebands 21 not shown in FIG. 1. To support the returning of the waveband to the original or unloaded position, in the critical regions of shoulders or pelvis of someone reclining on the unit, spiral springs 34 out of plastic or steel (compare FIG. 3) are positioned between the maxima of the intersecting wavebands with affixed plates and the cross slats 19 or the transverse double wires 26 (FIG. 2).

Figure 3:
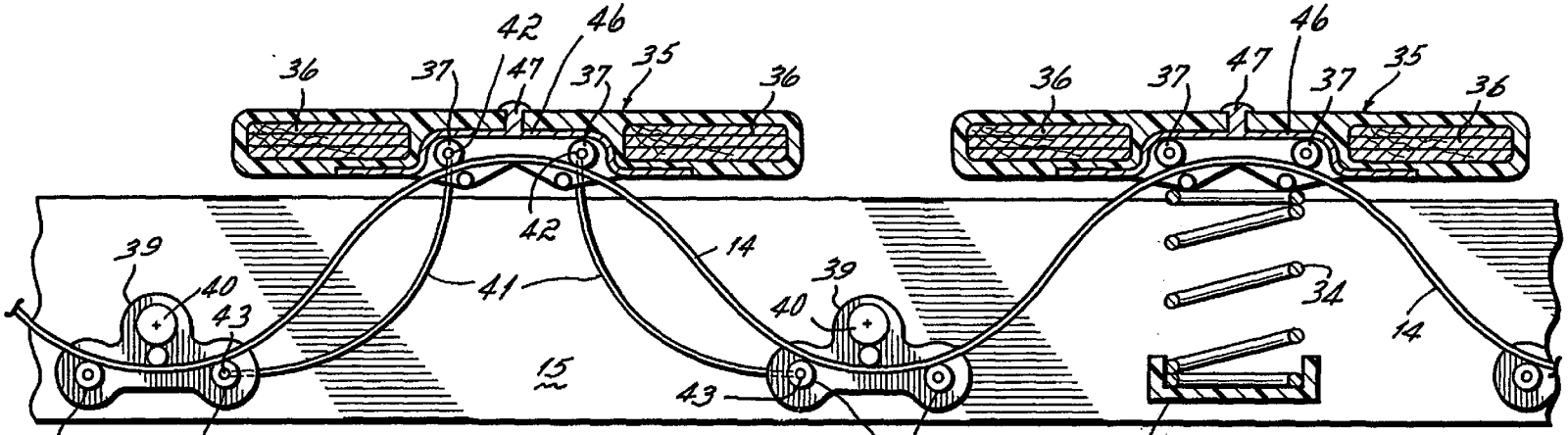
FIG. 3 is a cross-sectional view of two waveband-suspended double support elements of a bed underframe.

FIG. 3 shows the cross section of two segments of waveband 14 suspending double endcap support elements 35 for cross slats 36 out of plywood which move on roll bearings 37 on waveband 14. About eleven to thirteen of these segments are arranged parallel to both of the side spars 15 of a bed underframe. The movement of waveband 14 is guided on roller bearings 38 which are part of a bearing element 39 affixed to the side spar 15 of the frame. This bearing element 39 can be fixed to rotate around the mount journals 40. Two circular shaped spring steel wire bows 41 assure the return to position of the double endcap support element 352 due to tilting or longitudinal movements. These bows 41 have light portions that serve simultaneously as an axle 42, 43 of the rolls 37 or the roll bearings 38. To support the returning to an unloaded position both for perpendicular strokes as well as for tilting, the spiral spring 34 can be inserted instead of the spring steel wire bows 41 between the endcap support elements and a mounting 19 affixed to the frame. Round sliding rods 18 (compare FIGS. 1 and 2) can alternatively be used instead of rolls 38 when using slidable plastic material for waveband 14. The double endcap 35 made of flexible plastic like POM, ESPS, or SEPS, or the like is underlaid by a shell construction 46 and fixed thereto by means of a cap bolt 47. In that shell construction 46 two rolls or slide rods 37 are installed guiding the movement of the double endcap support element 35 upon the crest or maximum of the waveband 14.

The use of a moderately hard plastic with preferably low friction properties like polyetylene or polyamid makes it possible to form the double endcap 35 plus the shell construction 46 as one part. As an alternative to using roll or slide bearings, this endcap 35 and shell 46 construction can be clipped onto or affixed to the maximum of the waveband 14, like the support element plates 12 in FIGS. 1 and 2.

Figure 4A:
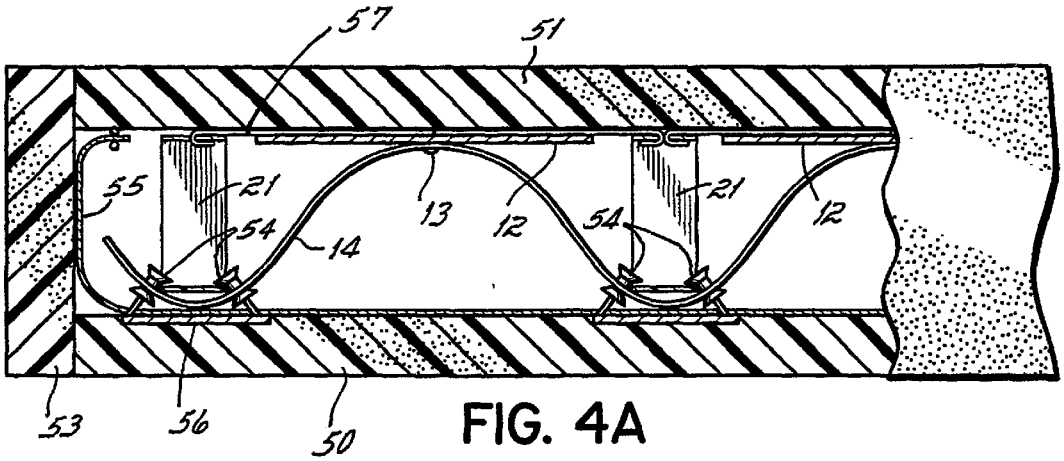
FIG. 4A is a cross-sectional view of a crossed waveband-suspended core of a mattress.
Figure 4B:
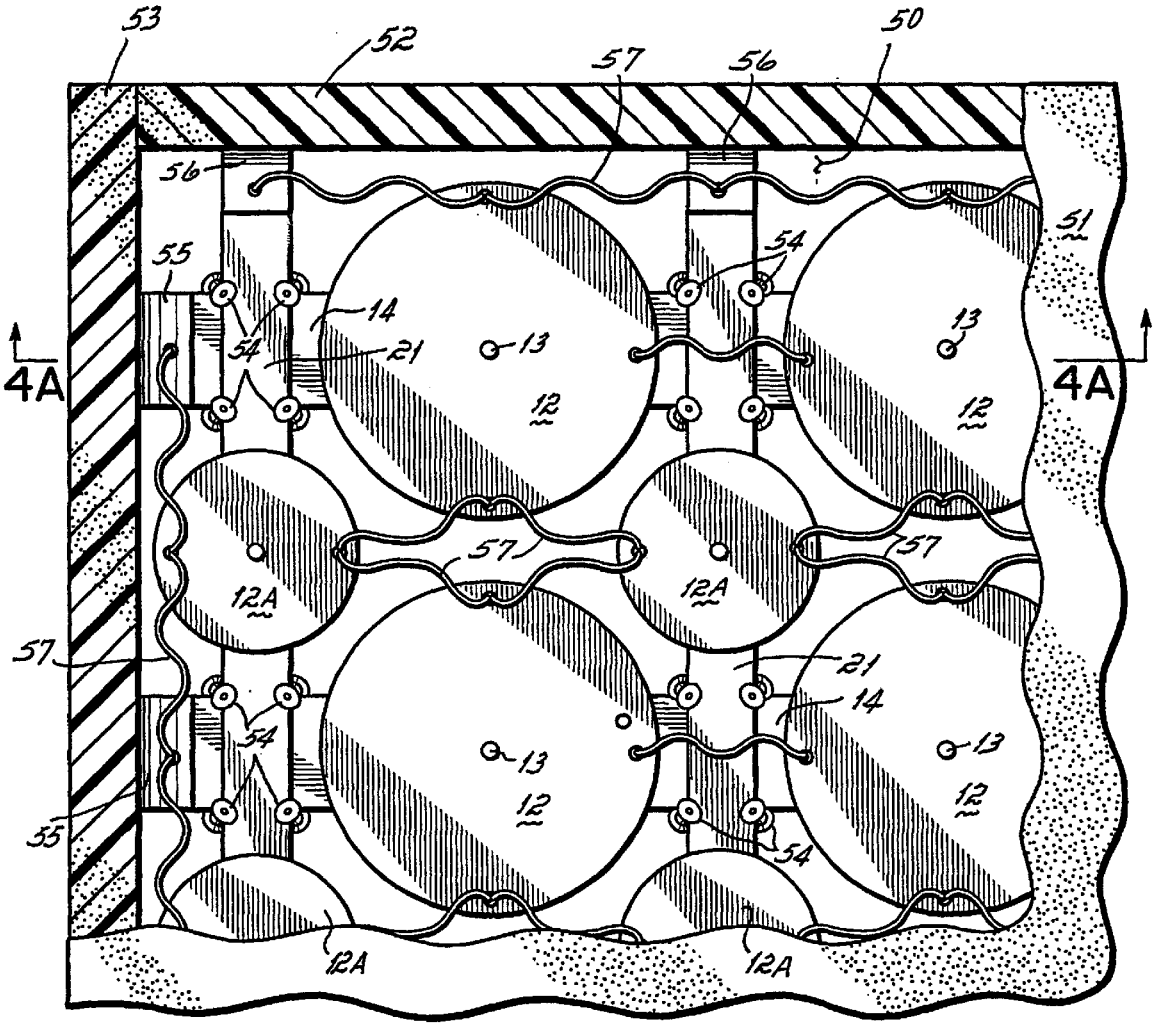
FIG. 4B is a top view of the crossed waveband-suspended mattress core of FIG. 4A.

FIG. 4A shows the cross section of two segments of wavebands 14, 21 to form a suspended mattress core, between a base 50 and a top 51 plate, as well as side 52, see FIG. 4B, and end parts 53 of frame elements made out of foam material.

In FIG. 4B the same section of the mattress core depicted in FIG. 4A is shown schematically in top view. Five to six 30–70 mm wide wavebands 14 run along the longitudinal axis of the core and ten to fourteen 20–50 mm wide wavebands 21 run crosswise thereto. Support element plates 12 and 12A, respectively, are affixed to the non-coinciding crests or maxima of each of the wavebands 14 and 21 with rivet-like bolts 13 (or form a material compound with the wavebands 14, 21). Movements of the juxtaposed troughs or minima are pairwise guided by means of a common bearing element in the form of four spool-like rolls 54 affixed to the junctures of the longitudinally and transversely running flexible bands 55 and 56, which are connected to one another and make up the base construction of the mattress core. The flexible bands 55, 56 are bent upward at the ends and thus define the unloaded height of the mattress core. These bearing bands should advantageously consist of 1 to about 3 mm thick plastic and are connected to one another by flat, cross-shaped springs out of plastic or spring steel wire (not shown). The support element plates 14, 21 can be linked to each other and to the end parts of the base construction bands 55, 56, that are bent in an upward direction (see FIG. 4A) by flat or wire springs 57.

When selecting a slidable material for the wavebands 14 and 21 and for the base construction, the spool-like rolls 54 may be replaced by sliding and securing rods flanged from the material of the base construction reaching alternatively from both sides over the waveband 14 and 21. The material chosen has to ensure an unhindered movement of the wavebands 14, 21 into other segments. The total basic bearing element construction, including the sliding and securing rods and the connecting flat spring elements, may be punched out of one piece of a flexible plastic plate and heat formed thereafter. This construction is suited for economical automated production and assembly of the mattress cores. In another construction, the supporting bands 55, 56 can be replaced by a wire net with integrated sliding bearings 27, (compare FIGS. 2 and 5).

Figure 5A:
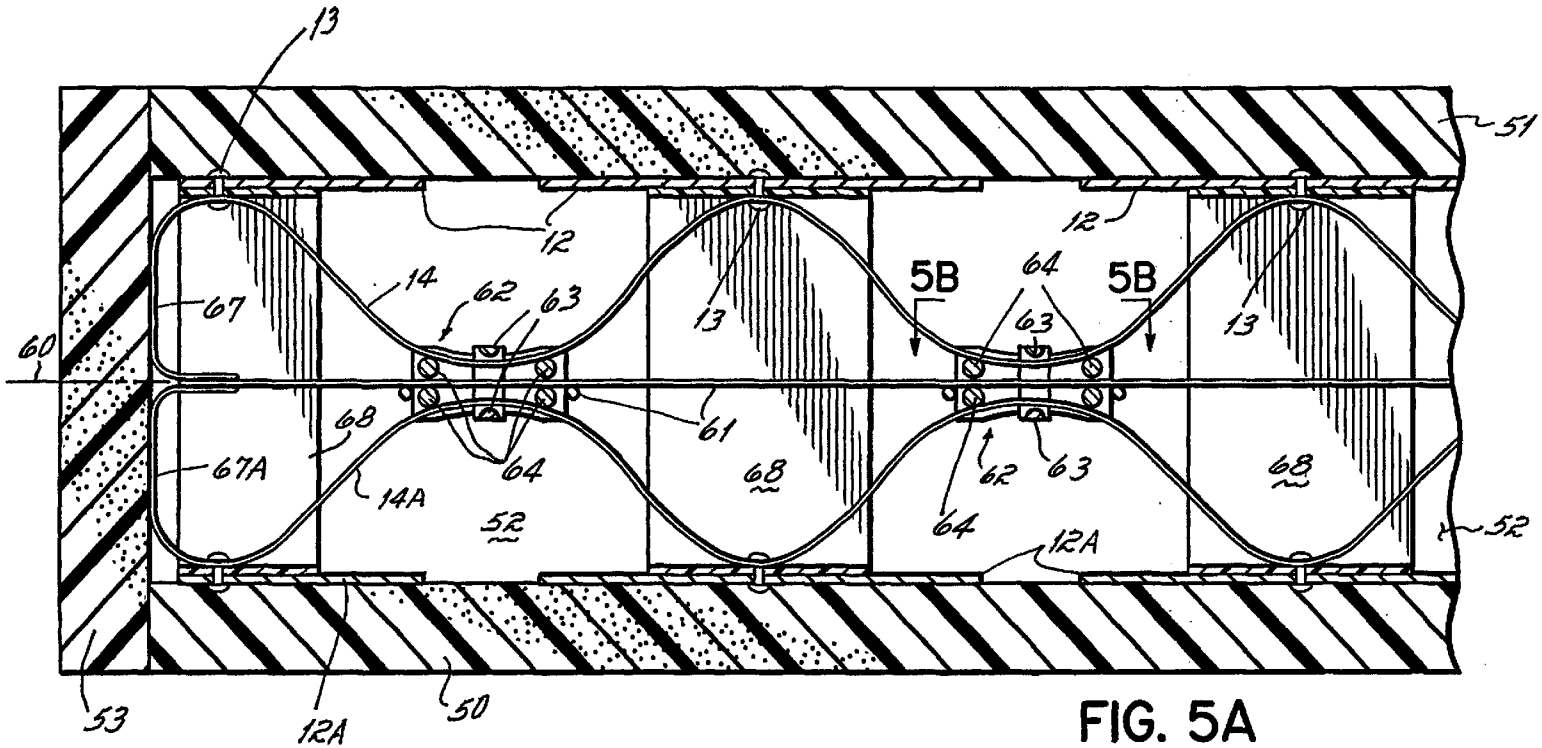
FIG. 5A is a cross-sectional view of a two story waveband-suspended mattress core.
Figure 5B:
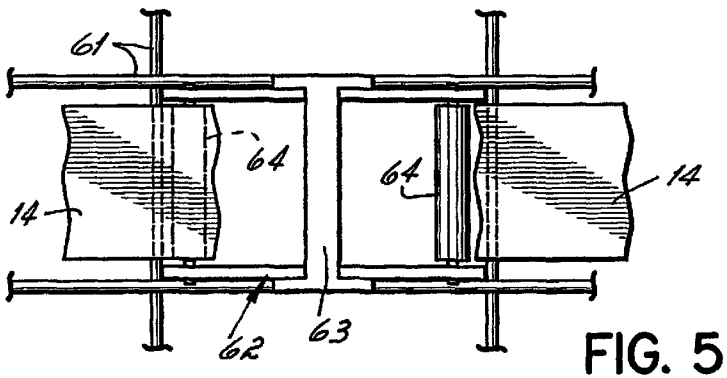
FIG. 5B is a top view of one embodiment of a bearing element in detail as seen on line 5B—5B of FIG. 5A.

Referring to FIG. 5A, the cross section of two segments of a double waveband 14, 14A suspended two story mattress core is shown. This core is symmetrically constructed around the dash-dotted central plane 60 and is built up between two cover plates 51 and 50 out of foam material which are underlaid and protected by, e.g., a cover of reprocessed wool (not shown) as well as the end parts 53 and the side parts 52 of the frame (compare FIG. 4B). Support plates 12 are fixed to the crests or maxima of the bands 14, 14A with rivet-like bolts 13 or the like.

A wire lattice or net 61 comprises the middle axis of the core and forms a part of the frame to support the minima or the troughs of the wavebands 14 and 14A. These wavebands run mirror-symmetrically on both sides over incorporated or separate roll- or slide bearing elements the latter of which are installed into a frame 62 inserted in the wire net 61 with the enlarged section of the frame shown in FIG. 5B in top view. Securing rods 63 that are also incorporated in the frame 62 or bearing element prevent the lifting off of the bands from the slide or roll bearings 64.

Five to seven of these double wavebands 14, 14A run parallel in a first direction to the longitudinal axis of the mattress, form the core, and are bent backwards for support in the end parts 67, 67A, and are affixed to the wire net 61. The choice of the net wire thickness (spring steel wire of about 1.5 to 2 mm diameter) of the net 61 will ensure a satisfactory stability. The support element plates 12 both of the outer wavebands 14, 14A are connected in pairs with U-shaped side parts 68 out of pliable-elastic material by means of the bolts 13. These side parts 68 and the end parts 67, 67A of the wavebands 14, 14A that are bent backwards define the unloaded normal height of the mattress core. To increase the inner stability of the core, the Upper support plates 12 of one waveband 14 may be connected to one another and the ones of the neighboring wavebands by spring elements (not shown). Likewise, the lower support plates 12 and the connecting spring elements can be produced, if required, out of the same material, e.g., out of a pliable- and tensile-elastic plate, by punching. All embodiments depicted in FIGS. 1 to 5 can be applied to cover only the central part of an underframe or a mattress still ensuring the very much increased adjusting and springy comfort of the coupled waveband suspension in the critical regions of shoulders and hips/pelvis. In case of the underframes, the waveband suspension can be applied for about one third up to two thirds of the surface, in particular in the critical regions. In the remainder of the underframe, cross slats with, e.g., Triflex, endcaps, or individual suspension elements, for instance of the Rotaflex type, can be installed. In the case of mattresses, for construction and cost saving reasons, it is advisable and advantageous to use a frame of one or two rows of normal spiral springs lengthwise of the mattress core and two to three rows at both ends of it. For the schemes depicted in FIGS. 2, 4, 5 and 6 in particular, wavebands consisting (in part) of spring steel wires as shown in FIGS. 8B to 8E can be used.

Figure 6:
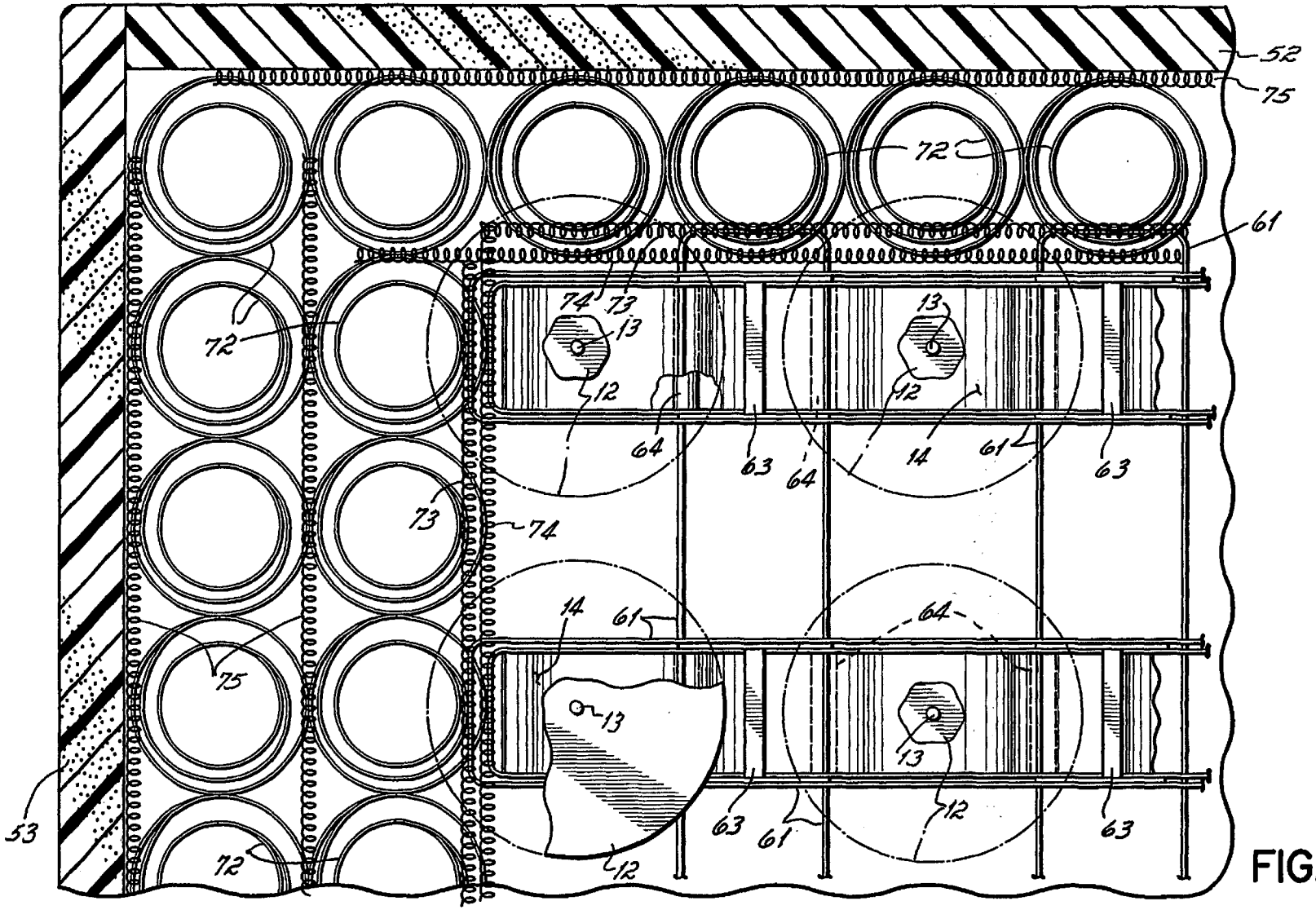
FIG. 6 is a top view of a two story waveband-suspended mattress core with a perimeter of spiral springs.

Referring to FIG. 6, a mattress construction is shown in top view using a two story waveband 14, 14A suspension for the inner part and a frame of one row of, i.e., Bonnelle spiral springs 72 lengthwise to the core and two rows at both the head and foot ends. The height of the springs 72 is adapted to that of the two story wavebands 14, 14A plus support element plates 12, wire net 61 and bearing elements 64. The central wire net 61 is affixed to the central windings of the springs 72 with suitable clips or spiraled lacing wire 73. The end parts of the wavebands 14 are fixed to the upper winding of spring 72 by a lacing wire 74. The springs 72 in the inner row can be of somewhat thicker wire gauge and are connected to one another by means of a spiraled lacing wire 75 at the top and the base end and at the middle spiral of the springs for reinforcement of the outer mattress frame. The single side row of springs 72 are similarly inter connected. This core is symmetric around the central wire lattice or net 61 and all the other elements are numbered as in FIG. 5A which, in principle, depicts the cross section of the inner waveband suspension portion of FIG. 6. The lower part of the double waveband 14A and the other corresponding elements thereof are not shown in FIG. 6. While this construction shows the elements of FIGS. 5 and 5A, it is to be understood that the elements of FIG. 2 could also be constructed with the Bonnelle springs 72.

Figure 7C:
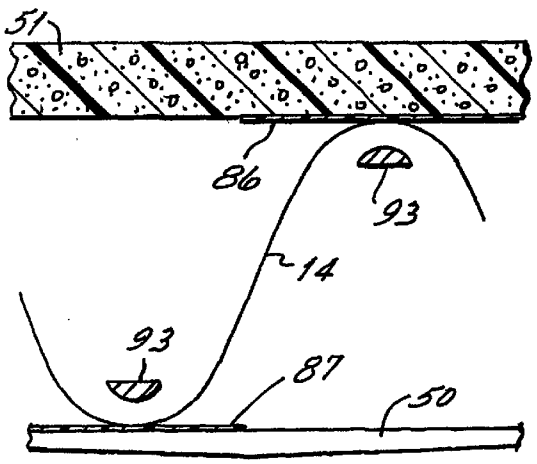
FIGS. 7C and 7D are cross-sectional views of a mattress core with single story crossed wavebands.
Figure 7D:
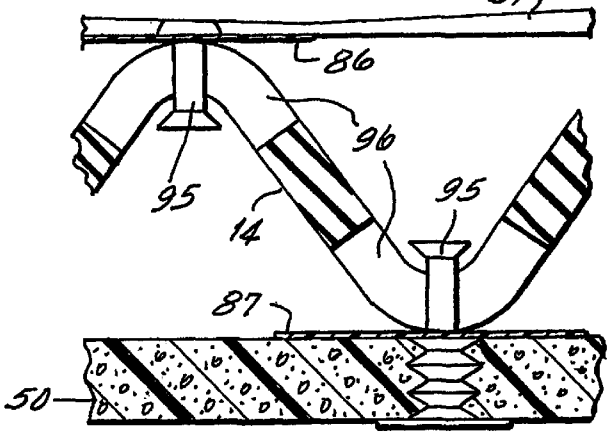
Figure 7A:
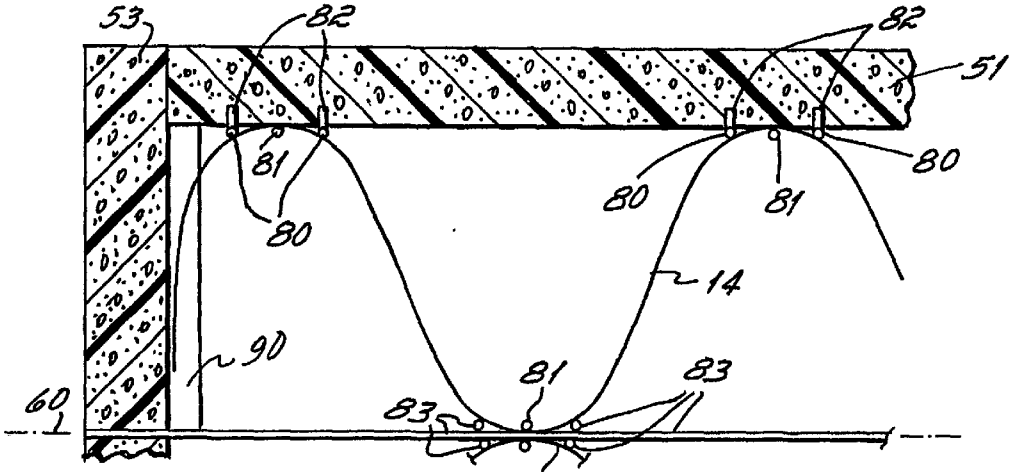
FIGS. 7A and 7B are cross-sectional views of a mattress core with two story wavebands.
Figure 7B:
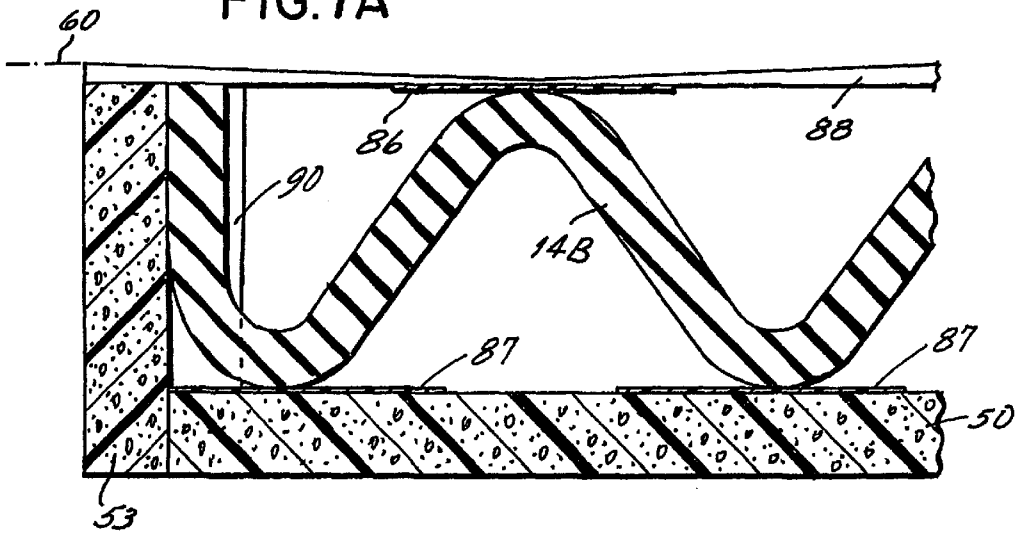
Figure 7E:
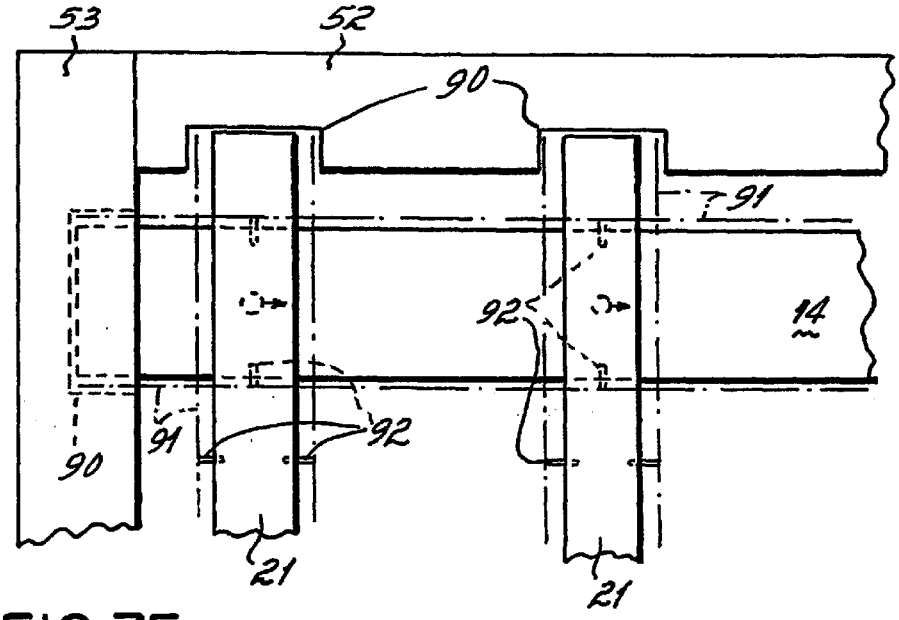
FIG. 7E is a top view of mattress core with crossed wavebands sliding on a lattice frame wire net.

FIGS. 7A and 7B depict in the cross sections the upper the lower part of two mattresses each symmetric around the dash-dotted central plane 60. Both two story mattress cores include elastically flexible crossed two story wavebands 14, 14B, 21 (see FIG. 7E) suspension between a top 51 and a base 50 plate of foam material. As in FIG. 6, the longitudinal bands as well as the transverse bands are running with equal phase In both stories of the unit at one wavelength λ interval (see FIG. 7E) and are mirror images of one another. Only one part of the double waveband 14 or 14B and corresponding elements are shown in FIGS. 7A and 7B. In FIG. 7A, the crests or maxima support a guiding net out of slidable plastic wires 80 with short securing wires 81 bent under or around the wavebands 14, 14B, 21 (FIG. 7E). If necessary, this net can be arrested with short wire ends 82 in the top 51 (and base 50) plate of the mattress. The minima are supported and guided by a central net of double-sided, slidable plastic wires 83.

Figure 7F:
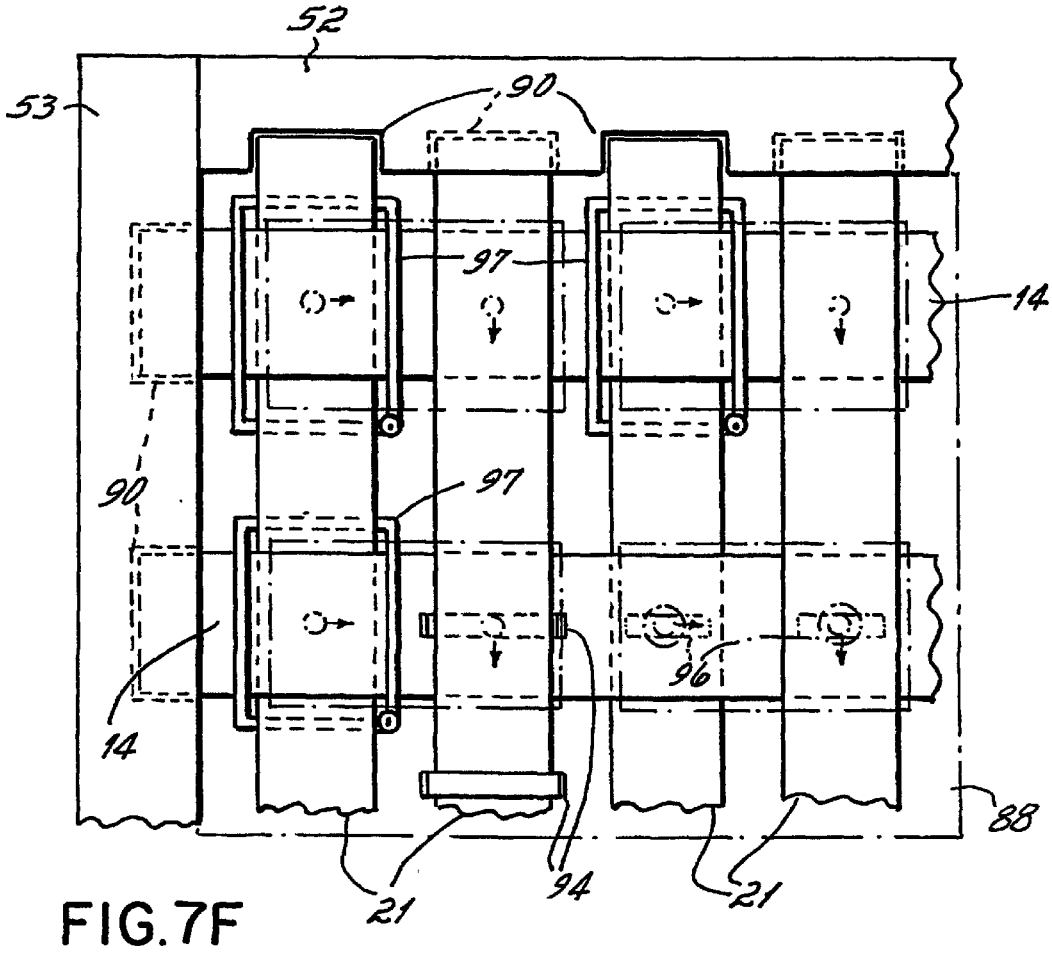
FIG. 7F is a top view of a crossed waveband-suspended mattress core with guiding/securing devices.

In the two story scheme of FIG. 7B and in the two story embodiment of FIG. 7F, thin, flexible, elastic, and slidable plastic sheets or patches 86, and 87 are coated, glued, mounted or otherwise affixed to the top 51 and base 50 foam plates of the mattresses opposite the normal unloaded position of the waveband maxima and minima, respectively. These sheets can be made of plastic (polyethylene, soft or hard PVC, or the like) or applied as a coating or sprayed directly onto the foam top 51, the base 50, and the central 88 plates. When choosing the wavebands and the foam top 51 and base 50 plates out of compatible, fairly slidable materials the patches 86 and 87 may be superfluous. In all embodiments of FIGS. 7A to 7F, the ends of the wavebands 14, 14B and 21 are secured and/or affixed in pockets or niches 90 of the end 53 or side 52 parts of the mattress out of foam material. The central plate 88 in FIG. 7B can be out of a harder, moderately flexible foam material with higher space weight than the top 51 and base 50 plates or can be replaced by a flexible, thinner sheet or plate of solid, slidable plastic material (soft or hard PVC, polyurethane). This sheet 88 may be perforated throughout or preferentially in the regions not directly opposite to the waveband maxima or minima, respectively, thus providing good transpiration of the mattress. The wavebands 14B in FIG. 7B are manufactured from a rubber-elastic foam material (polyurethane foam, moss rubber, or the like) and are of considerably larger thickness of 7 to about 25 mm. The width of the waveband 14, 14B in FIGS. 7A and B can be B=5–20 cm. Instead of the several wavebands 14, 14B shown in FIGS. 7A and B, only one to three broader wavebands may be used ranging over the total or portion of the width of the mattress core when a softer but still pliably elastic solid or foam material is chosen.

Referring to FIGS. 7C and 7D, one story mattress cores are shown with different securing/guiding devices. In FIG. 7E, a crossed single or two story waveband suspension of a mattress core consisting of five to six longitudinally 14 and 16 to 22 somewhat smaller, transversely running single or double wavebands 21 are shown. Both waveband groups are arranged at one wavelength λ intervals and are arranged in phase. The two story wavebands are mirror images symmetrically arranged around the central plate or wire 91 net of the core (only the upper part is shown). The guiding net out of slidable plastic wires 91 is shown on which both wavebands 14 and 21 can slide quite freely being only loosely held in place by short securing wires 92 reaching under the wavebands in the region of the crest or maxima.

In FIG. 7F the intervals of adjacent wavebands are λ/2 and with a phase shift of 180°. The troughs or minima of the longitudinal wavebands 14 are situated opposite the maxima of the transverse bands 21 and vice versa, with the maxima marked by a dashed circle (o) and the corresponding direction for the longitudinally running wavebands 14 by a horizontal arrow. The transverse wavebands 21 are marked by vertical arrows. Thus a completely resolved and coupled, sprung surface of the mattress is achieved. For both wavebands 14 and 21 either the solid or the foam plastic material can be used, each being elastically flexible.

Figure 8A:
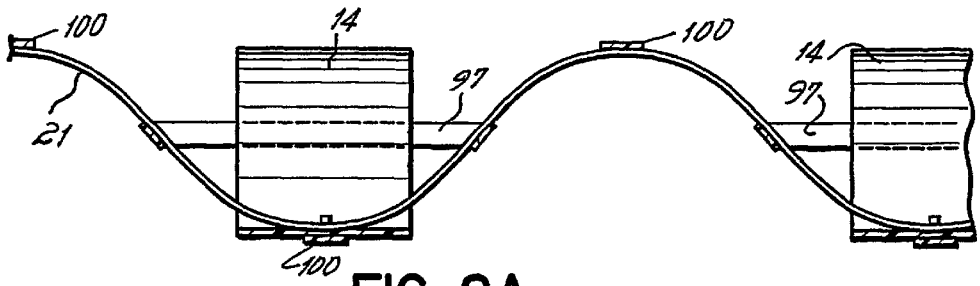
FIG. 8A is a cross-sectional view of crossed wavebands with slidable supports affixed to the extrema and securing/guiding bands.
Figure 8B:
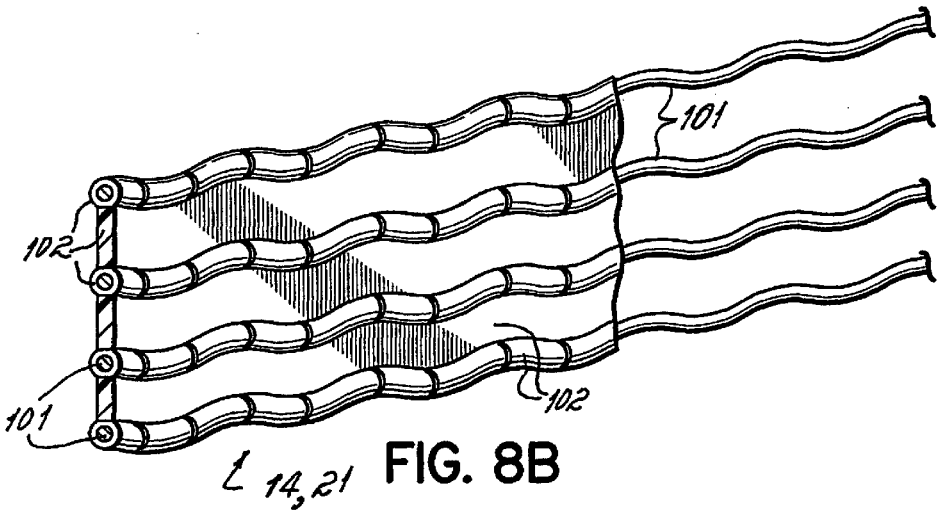
FIG. 8B is a combined top view and cross-sectional view of a waveband consisting of parallel spring steel wires interconnected by plastic bridges.
Figure 8C:
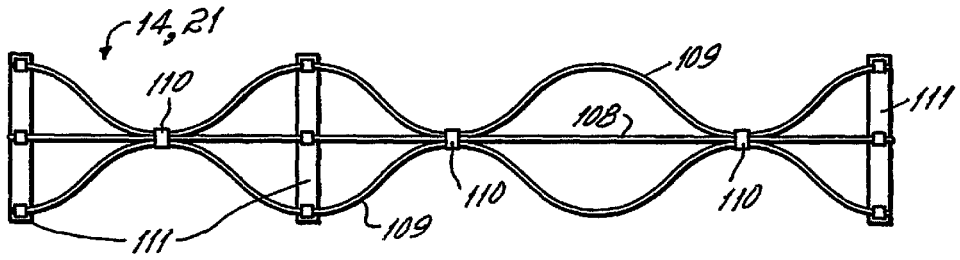
FIG. 8C to 8E are top views of wavebands consisting of spring steel wires.

In addition to the wire nets 83, 91 of FIGS. 7A and 7E, four further alternative embodiments are shown to secure and/or guide, if necessary, the crosswise running wavebands by: (i) securing rods 93 crossing the width of the mattress and affixed in the side parts 52 (FIG. 7C); (ii) securing bows 94 fixed to the top 51 and base 50 plates, and respectively to the central plate 88 (FIG. 7F); (iii) cap bolts 95 with an accordion-like fastening in the foam plates 50 and 51 that guide the wavebands 14 by gliding in slots 96 therein (every third to fifth maximum and the adjacent minimum in both waveband sets should be secured, FIGS. 7D and 7F); and installing elastic, securing square bands 97 around the middle turning lines of the two wavebands 14 and 21 (FIGS. 7F and 8A). The bands 97 may be clipped only on every third to fifth waveband crossing. Normally the niches or pockets 90 of approximately half the depth of the side or end foam parts and some square bands 97 are sufficient to hold the intersecting wavebands 14 and 21 securely in place during the normal use and lifetime of the mattress. These bows 94, bolts 95, and/or square bands 97 ensure the preservation of the normal unloaded shape of the mattress within the deviation due to the positive and negative stroke of the wavebands.

In the embodiments of FIGS. 7A to 7C, the waveband 14 and 21 minima and maxima move collectively and slide quite freely (with the exception of those minima and maxima loosely secured by the cross rods 93 or bolts 95), and thereby yield the effect of the negative and positive stroke characteristics for the waveband suspension. A partial lifting of the minima from the central 88 or the base 50 plates in the less heavily pressure loaded segments can occur and is tolerable and contributes to the positive stroke. In the embodiments of FIGS. 7A to 7F, the total stroke will not necessarily reach the order of H, the construction height of the mattress core, which is not the unique goal of these constructions taking into account the finite flexibility and pliability of the foam top and base plates of the mattresses. Nevertheless, very comfortable, simple and fairly inexpensive mattresses can be manufactured through these embodiments.

Referring to FIG. 8A, the cross section of crossed wavebands 14, 21 of a mattress core is shown. The wavebands 14, 21 are loosely held in place by elastic, square securing bows or bands 97 around the middle turning lines of the wavebands. Slidable supports 100 can be affixed to the minima and maxima of the wavebands.

Figure 8D:
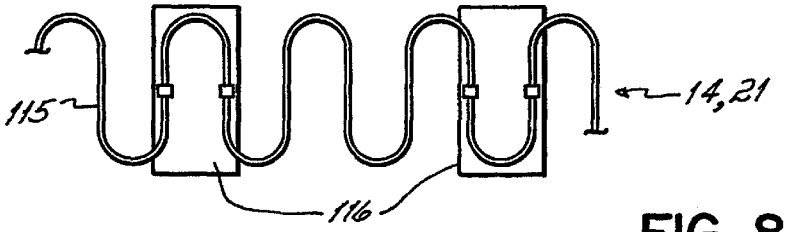
Figure 8E:
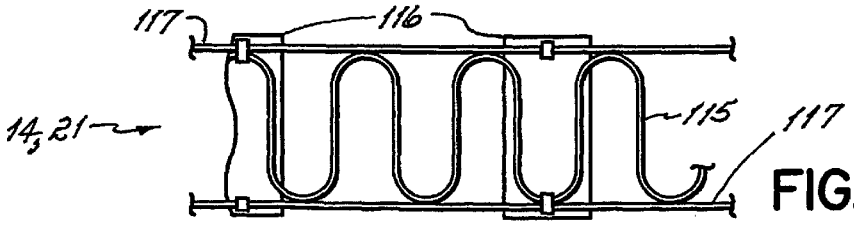

FIGS. 8B through 8E schematically depict the top view of the corresponding wavebands. 14 or 21 out of spring steel wires. The waveband of FIG. 8B includes four or several spring steel wires 101 mantled and interconnected by a plastic cover and bridges 102. When manufacturing this compound sinusoidal waveband 14 or 21, the plastic bridges 102 between the wires 101 can become bow-shaped, thus exposing the mantled wires 101 in the minima and maxima as the parts of the waveband that slide on the top and base plates of the mattress or on a corresponding bearing or support in an underframe, thus reducing the friction areas. The waveband 14 or 21 of FIG. 8C includes three wires, one straight 108 and two wavy wires 109 connected by cramps 110 and with supports 111 clipped to the trough or minima. The waveband 14 or 21 of FIG. 8D is made of a meandering wire 115 with supports 116 clipped into the wire spacing. The embodiment of FIG. 8E has, additionally to that in FIG. 8D, two straight steel wires 117 cramped or spot-welded to the extrema of the meandering wire 117. Here the supports 116 are clipped onto the straight wires 117. These spring steel wire wavebands 14, 21 can favorably be used in the embodiments shown in FIGS. 2, 4 to 7, and 12 instead of the wavebands out of plastic, steel or wooden band materials.

Figure 9A:
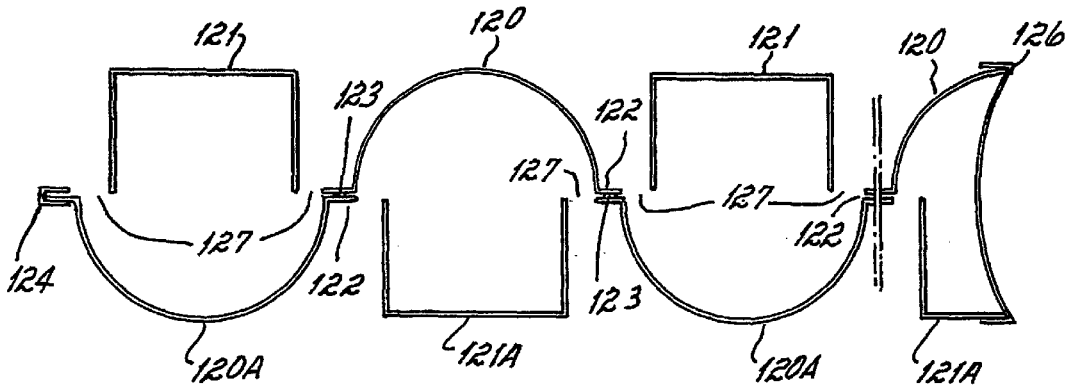
FIG. 9A is a cross-sectional view of crossed waveband sets of two halves of wavebands.

Referring to FIG. 9A, two crossed waveband sets 120, 121 and 120A, 121A are shown manufactured out of an upper and a lower half by a punching and warm deep drawing process of a sheet of suitable plastic. In the upper part of FIG. 9A, the positive half waves of the first waveband set are directed longitudinally and those of the second set are directed transversely to the axis of the underframe or mattress. In the lower part of FIG. 9A the corresponding negative half waves are shown. The upper and the lower halves are, in principle, mirror images of one another and are, shifted by a phase shift of 180° or half a wavelength $\lambda/2$ and are connected at the bridges 122 by means of spot-welding points 123 or are glued together. Thereby the two sets of wavebands are obtained with all the maxima of one set opposite to the minima of the other one, and vice versa.

The rims of that two sheet construction can be reinforced by means of U-shaped plastic bands 124 and 125 spot-welded or glued to the outer bridges 122. The ends of the waveband sets can as well be secured by Σ-shaped flexible plastic bands 126 spot-welded or glued to the outer maxima and minima, respectively (see the right part of FIGS. 9A and 9B).

Figure 9B:
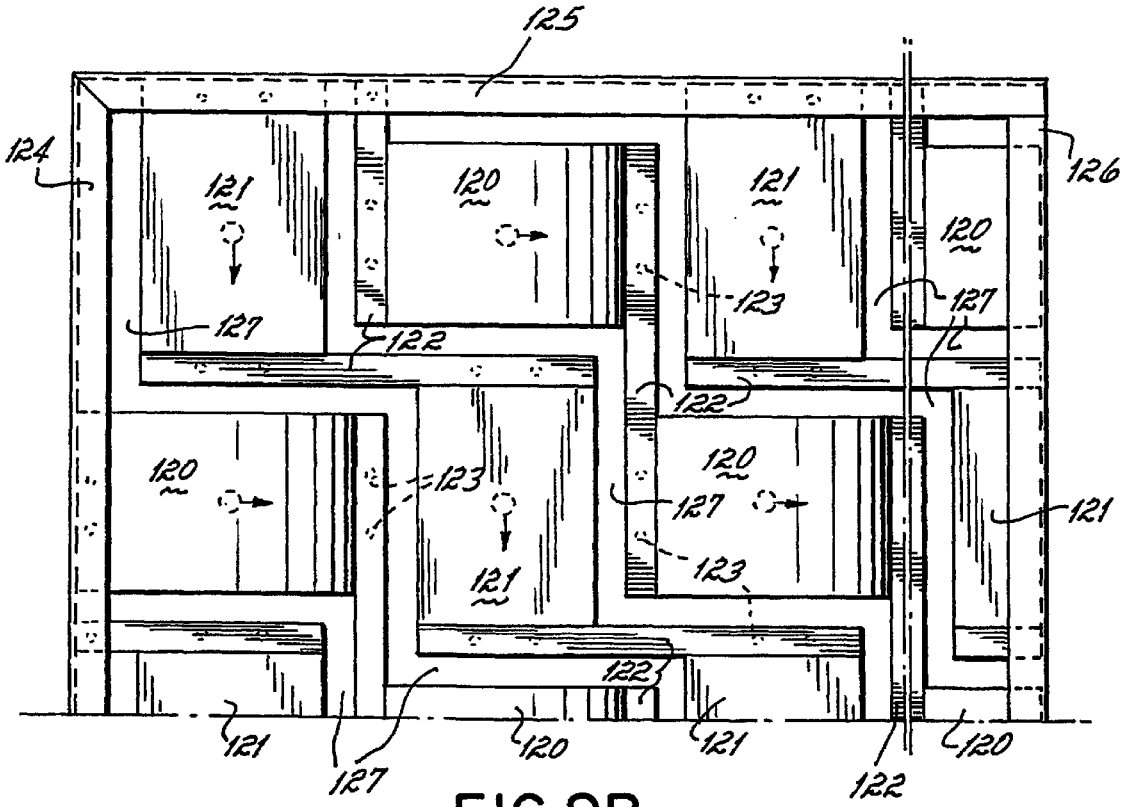
FIG. 9B is a top view of crossed waveband sets of two halves.

FIG. 9B shows the top view onto the upper half waves of the waveband sets of FIG. 9A with punched out interspacings 65 and with the bridges 122 arranged such that each half wave is connected at one side to the next parallel running one. Thus an interconnected, well coupled waveband suspension is obtained having the intrinsic characteristic of flexibility and simultaneously holding the crossed waveband system together.

In the waveband suspension of this embodiment, the tight spacing between the maxima or minima on both sides eliminates the need for additional, separate support elements like those in FIGS. 1 to 4 or patches (sheets) as shown in FIGS. 7C, D, and F. This embodiment is, principally, suited as well for bed underframes as for mattresses with a suitable support net or foam top and base plates, respectively.

Figure 10A:
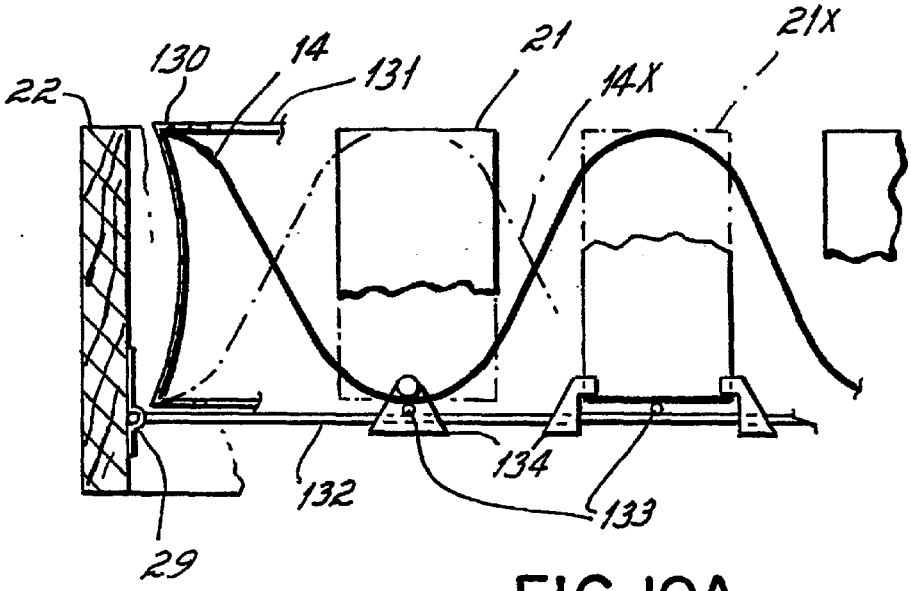
FIG. 10A is a cross-sectional view of a crossed waveband suspension for a bed underframe.
Figure 10B:
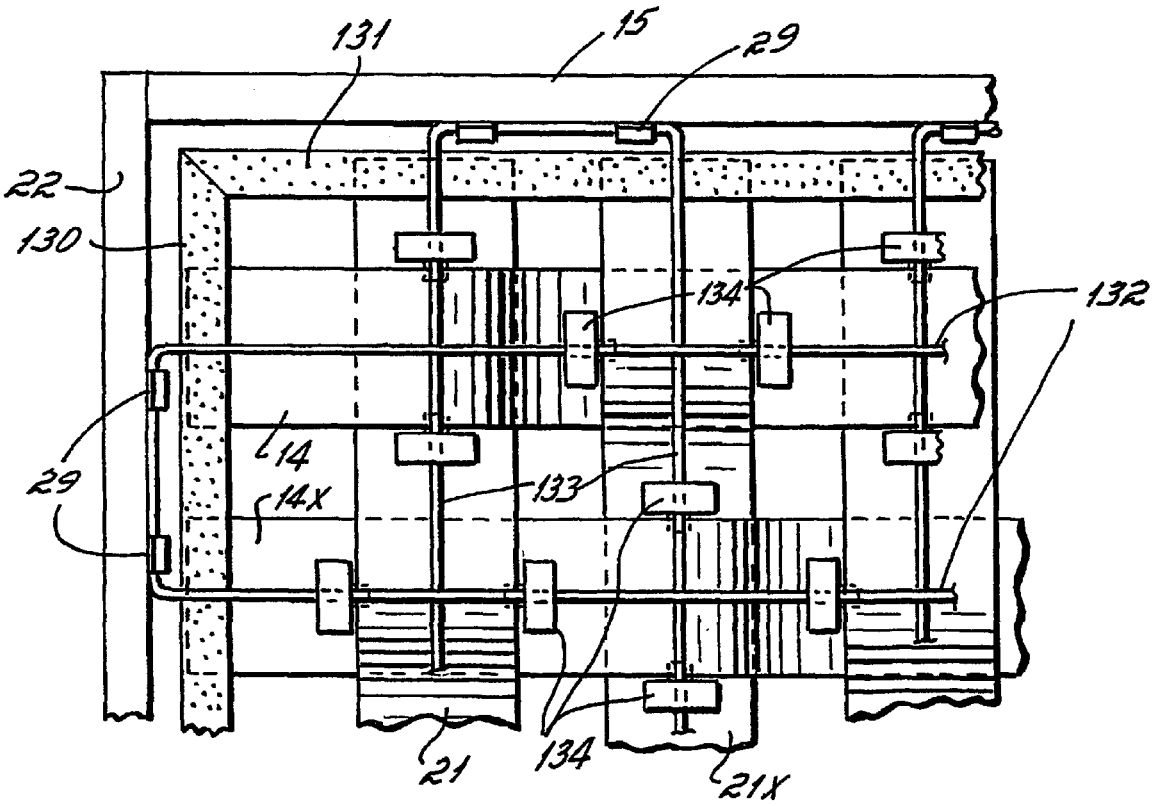
FIG. 10B is a top view of the crossed waveband suspension of FIG. 10A.

FIGS. 10A and 10B depict schematically the cross section and bottom view, respectively, of an underframe suspension composed of two sets of wavebands 14, 21 and 14X, 21X, one longitudinally and the other one transversely running with the neighboring wavebands shifted by half a wavelength $\lambda/2$. The maxima at the end of the two waveband sets are affixed, e.g., by spot-welding or glueing to Σ-shaped flexible and pliable plastic bands 130 and 131 which provide the waveband stops as well as the appropriate spatial consistency of the waveband suspension. The minima of the wavebands are supported by a net or lattice of longitudinally 132 and transversely 133 arranged wires which are affixed to as a part of the side 15 or head and foot 22 spars of the frame by cramps 29. Securing devices 134 with small sticks reaching over the rims of the wavebands 14 and 21 are clipped onto those wires 132 and 133. In this version, as in FIGS. 9A and B, no additional, separate support elements are necessary and an adjustable mattress can be placed directly on the tightly lying maxima.

Figure 11:
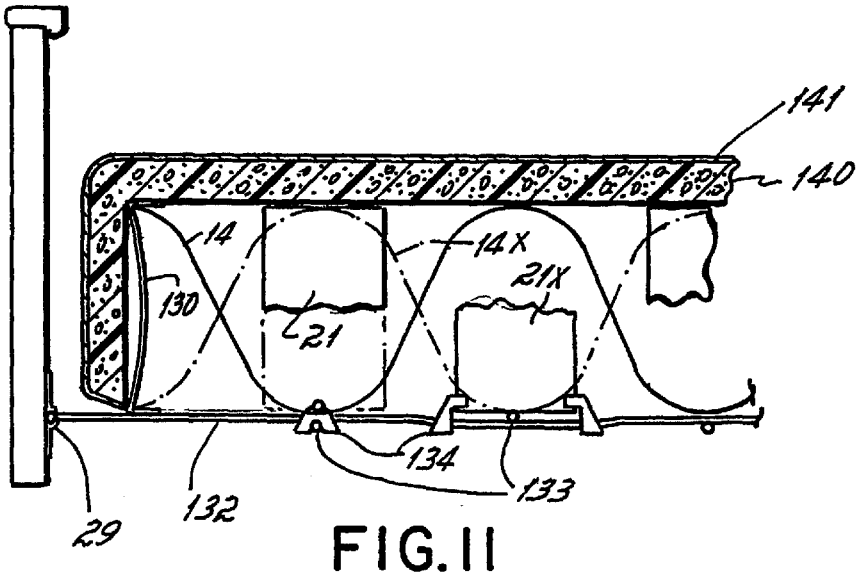
FIG. 11 is a cross-sectional view of a seating unit with crossed waveband suspension.

Referring to FIG. 11, the same embodiment as in FIGS. 10A and B with identical numbering is used for the upholstery of seats and couches or the combination of an underframe and a mattress with a foam plate 140 covering the top and the side parts of the core construction. A cover sheet 141 surrounds the foam plate 140. The wavebands are riding on a wire net as in FIGS. 10A and 10B. The enormous adjustability of the waveband suspension yields an extremely comfortable upholstery or makes this combination and reduction of an underframe and a mattress to one single item possible.

Figure 12A:
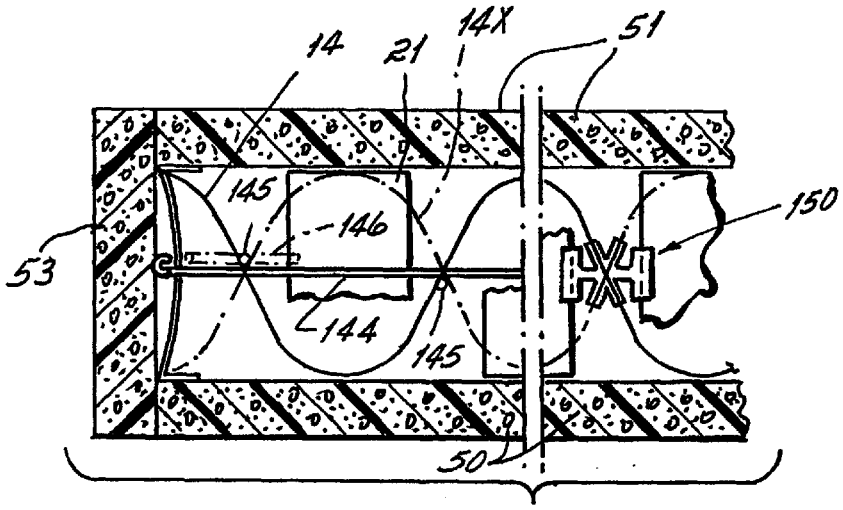
FIG. 12A is a cross-sectional view of a crossed waveband suspension with guiding/securing devices.
Figure 12B:
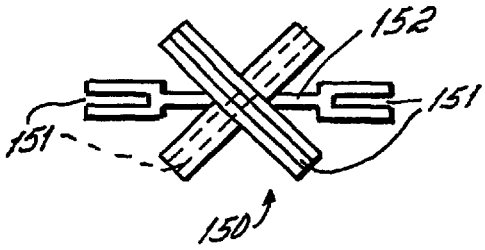
FIG. 12B is a side view of the guiding/securing device of FIG. 12A in detail.
Figure 12C:
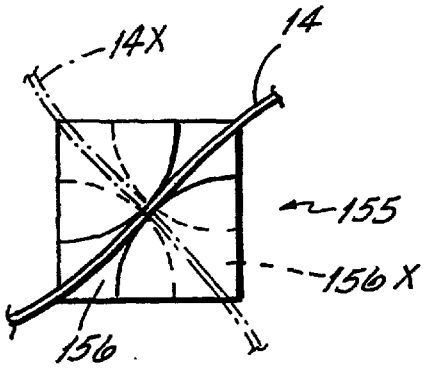
FIG. 12C is a front view of an intersection cube for waveband guiding/securing.

Referring to FIG. 12A, the cross sections of mattress cores between top 51, base 50, and end 53 foam plates of en embodiment similar to the schemes of FIGS. 10 and 11 with analogous elements numbered alike is shown. In FIG. 12A the crosswise running wavebands 14, 14X and 21, 21X are guided and/or secured by means of longitudinal 144, transverse 145 and/or diagonal 146 rods reaching across the length, the width of the mattress, or are arranged diagonally. These rods are held in place by bending them to hooks behind the Σ-shaped flexible plastic band 130 and 131. The rods 144, 145 and/or diagonal 146 rods are situated approximately in the middle at the turning lines of the wavebands 14, 14X and 21, 21X with alternating positions like the threads in a fabric. On the right side of FIG. 12A a guiding/securing device 150 for the four intersecting wavebands 14, 14X and 21, 21X is shown which has the form of a cross out of elastic plastic or rubber with U-shaped pockets 151 holding the wavebands at the turning lines. These pockets are arranged at approximately 90° to the one opposite at the other end of the round, cross-like interconnections 152 (FIG. 12B). Another guiding/securing device 155 out of foam can give in beyond the limits set by the V-shaped cuttings 156, 156X. All shown guiding/securing devices can be easily. inserted, e.g., only at every fourth to sixth intersecting point, to ensure the spatial consistency of the mattress core.

The embodiments described in FIGS. 2, 4, and 5 to 12 are especially suited for automated mass production and assembly of the mattress cores or resolvedly sprung underframes, instead of the box-spring foundations or spiral spring cores in use today. In these versions the thickness of the mattress core may be reduced by about one half compared to the typical American box-spring or the usual European mattresses.

The material for the sinusoidal wavebands 14 and 21 with a width of about B=20–70 mm (or 70–250 mm) can be permanently elastic, solid plastic, like Hytrel®, Amitel®, polyurethane, and polypropylene (or of a foam plastic, polyurethane or moss foam, or the like) or can be made of glass fibre reinforced epoxy, spring steel or duralumin band, of connected spring steel wires, or of formed, laminated wood. Those materials or compounds should have the corresponding properties of springiness and elasticity. Depending on the application, the material and width of the waveband, the thickness can be 0.2–0.5 mm for spring steel and 1.5–2.5 mm for Hytrel®, and 2–4 mm for polyurethane, and 5–25 mm for the foam materials. The module for bending and for elasticity E can, depending on the material and the thickness, be chosen in a wide range of about $10–10^4$ MPa, e.g. of E=100–570 MPa for the Hytrel®, standard types 4556 or 7246, or 10 to 100 for the foam materials at room temperature.

Because of the bending elasticity of the wavebands, the adjusting of the head and/or foot end of the bed underframe is possible, as is the installation of the waveband suspension in a motor-driven frame, by using a turning bolt or rod fixed to the frame. Use of the appropriate materials for the wire 61 or the band net 55, 56 and the connecting springs 57 or tongues between the support plates 12, 12A, an adjustment and a rolling up of the mattress is possible with bending radii of ¼ of the total length of the mattress.

For a very large load due to heavy bodies and when using plastic that tends to break more easily, it is advantageous to install a stop in the middle between the waveband troughs or minima. These stops are normally unnecessary for the wavelength λ=12.8–17 cm and when high quality plastics like Hytrel®, Amitel®, or polyurethane are used, or for spring steel band or wires.

The wavebands can be produced at low cost in continuous extrusion process with subsequent forming of the sinusoidal wave or the crossed waveband sets 120, 121 manufactured in two parts by a warm deep drawing and punching process out of two sheets of suitable plastic which are later connected. The wavebands 14, 21 and the support element 12, 12A or the support element endcaps 35 can consist of the same material or can be made of a material compound and can be produced in a single die-casting process. In this case, it is possible to produce segments that are later connected. This makes it possible to choose varying properties with respect to elasticity and resetting for the regions where the shoulders and pelvis rest as well as for the head and feet areas. A punching process with subsequent heat forming is also useable. An advantageous property of the waveband suspension is the low shearing tendency lateral to the waveband, naturally strongly decreasing with the width of the band. The greater capacity for shearing in the direction of the waveband is in fact desirable to avoid steps whereby the ability of adjusting in a vertical direction prevails. The special advantage of the support elements coupled by the waveband(s) is the springy lowering of individual segments that lead to a positive stroke for other segments.

The displacement $-\Delta\int_n$ of the band by lowering the pressure loaded segments with a negative stroke leads inevitably to an effective lengthening $+\Delta L_p$ of the band and to a heightening of the maxima in the neighboring segments, i.e. to a positive supporting stroke. Assuming a constant total length of the undulated band, the sum $-\Sigma\Delta L_n+\Sigma\Delta L_p=0$.

A total stroke of $h=h_1+h_2\leqq 7/6\ H$ is attained as the sum of the lowering stroke $h_1\leqq -2/3\ H$ plus the positive stroke $h_2\leqq +1/2\ H$. i.e., at least a stroke of the construction height H of the waveband-suspended support elements. For the height H=50–100 mm of the waveband made from solid material plus support elements a total stroke h=59–115 is possible.

The rising characteristic of the wavebands 14, 21, 120, 121 means that the spreading of band shift is inherently restricted to the segments immediately next to the pressure loaded ones and to those adjacent or nearby. This characteristic property is hardly even influenced if roll bearings are chosen, which cause a very small amount of friction, as opposed to slide bearings which are subject to material-influenced friction. This implies choosing wavelengths in the upper range of λ=15–18 cm and thereby 11 to 14 support elements per waveband. With a body of normal dimensions lying on it, a resolve, sprung surface is provided. The interaction of several neighboring segments leads to a low progression of first rough contour adjustment to the reclining body because of the waveband characteristic and, as the condition of equilibrium is approached, to a springy suspension. The largest lowering in the sections of the shoulders and hips give rise to a positive support action in the sections of head and neck as well as of hip (lumbar vertebrae) when the human body is lying on the side (or back), and thereby to an optimum springy suspension by the waveband suspended underframe as well as the mattress.

When using formed laminated wood for the wavebands, underframes can be manufactured absolutely metal-free and almost completely out of wood except for some plastic materials for slide or roll bearing elements and connecting pieces.

The resilient comfort of the waveband suspension is so high that very simple underframe constructions or thin foam, latex, or futon mattresses can be used together with the waveband suspended counterpart. Two direct consequences of this highly resilient comfort of the waveband suspension are achieved. Firstly, for the underframes the mattress used with it can be reduced in height to reproduce the adaptability of the frames and to provide the necessary thermal insulation along with a good transpirability. Thin, 80–150 thick, mattresses made of perforated cold foam or latex or even a futon mattress can be selected. Secondly, for the mattresses, in principle, underframes can be used consisting of a wooden board or lattice. Good choices are frames, adjustable in the head and foot parts, with cross-banded fabric or wire surfaces like box-spring foundations which have no or not much of an inherent adaptability. In both cases the total costs can thus be considerably reduced.

From the above disclosure of the general principles of the present invention and the preceding detailed description of at least one preferred embodiment, those skilled in the art will readily comprehend the various modifications to which this invention is susceptible. Therefore, we desire to be limited only by the scope of the following claims and equivalents thereof.

I claim:

1. A bedding or seating unit comprising:

a frame defining a plane;

at least one band extending generally within the frame and having a plurality of alternating crests and troughs when the unit is in an unloaded configuration;

a support element coupled to the crests of the band upon which a load applied to the unit is supported;

a bearing element coupled to each of the troughs of the band and mounted to the frame;

wherein when the load is applied the support element at selected crests, the selected crests move generally perpendicularly to the plane toward the adjacent troughs and the crests adjacent to the selected crests move generally perpendicularly to the plane away from the troughs adjacent thereto.

2. The unit of claim 1 wherein each crest is generally equally spaced in a direction perpendicular to the plane from an adjacent trough when the product is unloaded.

3. The unit of claim 1 further comprising a plurality of the support elements, each of which is coupled to one of the crests of the band.

4. The unit of claim 1 further comprising:

a plurality of the bands and the associated crests, troughs, support element and bearing elements, the plurality of the bands being oriented generally parallel to one another in a first direction in the frame.

5. The unit of claim 4 wherein the plurality of the bands oriented in the first direction comprise a first set of the bands, the unit further comprising:

a second set of the bands and the associated crests and troughs, the second set of the bands being oriented generally parallel to one another in a second direction in the frame and generally perpendicular to the first direction.

6. The unit of claim 5 wherein each of the crests of the bands in the first set is juxtaposed to one of the crests of the bands in the second set at a common support element.

7. The unit of claim 5 wherein each of the troughs of the bands in the first set is juxtaposed to one of the troughs of the bands in the second set at a common bearing element.

8. The unit of claim 1 further comprising:

a plurality o f link elements coupling together adjacent support elements of adjacent crests.

9. The unit of claim 1 wherein each of the bearing elements is fixedly mounted to the frame so that a position of each of the troughs is fixed relative to the frame.

10. The unit of claim 1 wherein the band is moveable relative to the bearing elements proximate to the selected crests as the load is applied to and removed from the unit.

11. The unit of claim 1 wherein the support element is generally parallel to the plane when the unit is unloaded and the support element at the selected crests pivots relative to the plane in response to the load.

12. The unit of claim 1 further comprising:

a spring coupled to certain crests to bias the certain crests toward their unloaded configuration.

13. The unit of claim 1 wherein the frame further comprising:

a plurality of interconnected peripheral frame elements; and a lattice of interior frame elements coupled to the peripheral frame elements, the bearing elements being mounted to the peripheral or interior frame elements.

14. The unit of claim 4 wherein the plurality of the bands oriented in the first direction comprise a first set of the bands, the unit further comprising:

a second set of the bands and the associated crests and troughs, the second set of the bands being oriented generally parallel to one another in the first direction in the frame and generally parallel to the first set.

15. The unit of claim 14 wherein each of the troughs of the bands in the first set is juxtaposed to one of the troughs of the bands in the second set at a common bearing element and each of the crests of the bands in the first set is spaced from one of the crests of the bands in the second set in a direction generally perpendicular to the plane.

16. The unit of claim 1 wherein the frame further comprises:

a plurality of springs arranged adjacent to the periphery of the unit.

17. A bedding or seating unit comprising:

a frame defining a plane and having a plurality of interconnected peripheral frame elements and a lattice of interior frame elements coupled to the peripheral frame elements;

a plurality of bands extending generally parallel to one another in a first direction within the frame and each of the bands having a plurality of alternating crests and troughs when the unit is in an unloaded configuration;

a plurality of support elements each of which is coupled to one of the crests of one of the bands and upon which a load applied to the unit is supported;

a plurality of bearing elements each of which is coupled to one of the troughs of one of the bands and fixedly mounted relative to the frame so that a position of each bearing element is fixed relative to the frame, each of the bands being moveable relative to the associated bearing elements as the load is applied to and removed from the unit;

wherein when the load is applied the support element at selected crests, the selected crests move generally perpendicularly to the plane toward the adjacent troughs and the crests adjacent to the selected crests move generally perpendicularly to the plane away from the troughs adjacent thereto, wherein each of the support elements is generally parallel to the plane when the unit is unloaded and the support elements at the selected crests pivot relative to the plane in response to the load.

18. The unit of claim 17 wherein the plurality of the bands oriented in the first direction comprise a first set of the bands, the unit further comprising:

a second set of the bands and the associated crests and troughs, the second set of the bands being oriented generally parallel to one another in a second direction in the frame and generally perpendicular to the first direction.

19. The unit of claim 18 wherein each of the crests of the bands in the first set is juxtaposed to one of the crests of the bands in the second set at a common support element.

20. The unit of claim 18 wherein each of the troughs of the bands in the, first set is juxtaposed to one of the troughs of the bands in the second set at a common bearing element.

21. The unit of claim 17 further comprising:

a plurality of link elements coupling together adjacent support elements of adjacent crests.

22. The unit of claim 17 wherein the support elements are generally parallel to the plane when the unit is unloaded and the support elements at the selected crests pivot relative to the plane in response to the load.

23. The unit of claim 17 further comprising:

a spring coupled to certain crests to bias the certain crests toward their unloaded configuration.

24. The unit of claim 17 wherein the plurality of the bands oriented in the first direction comprise a first set of the bands, the unit further comprising:

a second set of the bands and the associated crests and troughs, the second set of the bands being oriented generally parallel to one another in the first direction in the frame and generally parallel to the first set.

25. The unit of claim 24 wherein each of the troughs of the bands in the first set is juxtaposed to one of the troughs of the bands in the second set at a common bearing element and each of the crests of the bands in the first set is spaced from one of the crests of the bands in the second set in a direction generally perpendicular to the plane.

26. The unit of claim 17 wherein the frame further comprises:

a plurality of springs arranged adjacent to the periphery of the unit.

* * * * *

UNITED STATES PATENT AND TRADEMARK OFFICE

CERTIFICATE OF CORRECTION

PATENT NO. : 6,647,574 B2
DATED : November 18, 2003
INVENTOR(S) : Erhard Weber

It is certified that error appears in the above-identified patent and that said Letters Patent is hereby corrected as shown below:

Column 1,
Line 5, “hereby Incorporated by” should read -- hereby incorporated by --.

Column 4,
Line 63, ‘tat” should read -- at --.

Column 7,
Line 8, “the Upper support” should read -- the upper support --.

Column 9,
Line 46, “wavebands. 14 or 21” should read -- wavebands 14 or 21 --.

Column 11,
Line 23, “be easily. inserted” should read -- be easily inserted --.

Column 12,
Line 32, “+ ½ H. i.e.,” should read -- + ½ H, i.e., --.

Column 15,
Line 10, “bands in the, first” should read -- bands in the first --.

Signed and Sealed this

Eighth Day of June, 2004

JON W. DUDAS
*Acting Director of the United States Patent and Trademark Office*